US006623286B2

(12) United States Patent
Tachi

(10) Patent No.: US 6,623,286 B2
(45) Date of Patent: Sep. 23, 2003

(54) LEVER-TYPE CONNECTOR

(75) Inventor: Hideshi Tachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/201,113

(22) Filed: Jul. 22, 2002

(65) Prior Publication Data

US 2003/0017026 A1 Jan. 23, 2003

(30) Foreign Application Priority Data

Jul. 23, 2001 (JP) ..... 2001-221521
Jul. 23, 2001 (JP) ..... 2001-221632

(51) Int. Cl.[7] ..... H01R 13/62
(52) U.S. Cl. ..... 439/157
(58) Field of Search ..... 439/157, 372, 439/160, 152

(56) References Cited

U.S. PATENT DOCUMENTS 5,279,506 A * 1/1994 Kawase et al. ..... 439/157
5,820,409 A * 10/1998 Clark et al. ..... 439/157
5,839,912 A * 11/1998 Schekalla et al. ..... 439/157
6,447,312 B1 * 9/2002 Takata ..... 439/157

FOREIGN PATENT DOCUMENTS

JP 3-126379 12/1991
JP 5-8882 5/1993

* cited by examiner

*Primary Examiner*—Tho D. Ta
(74) *Attorney, Agent, or Firm*—Anthony J. Casella; Gerald E. Hespos

(57) ABSTRACT

A connector housing (10) has supporting walls (14) and support shafts (21) project in from the inner side surfaces of supporting walls (14). A lever (30) has arms (32) disposed inwardly of the supporting walls (14). Bearing holes (33) formed in the arms (32) are mounted rotatably on the support shafts (21). The arms (32) try to move wider apart upon the engagement of cam grooves (34) on the arms (32) with cam pins (Mp) on a mating connector (M). However, the arms (32) are displaced in directions to move the bearing holes (33) from the projecting ends toward the base ends of the support shafts (21). Therefore, engaging areas of the bearing holes (33) and the support shafts (21) are not reduced.

9 Claims, 13 Drawing Sheets

LEVER-TYPE CONNECTOR

BACKGROUND OF THE INVENTION

1. Field of the Invention

The invention relates to a lever-type connector.

2. Description of the Related Art

A known lever-type connector is disclosed in Japanese Utility Model Publication No. 3-126379. The connector has a housing with opposite outer side surfaces and supporting shafts that project from the outer side surfaces. The connector also has a lever with an operable portion and a pair of arms that project from the opposite ends of the operable portion. Bearing holes extend through the arms and cam grooves are formed in the inner surfaces of the arms. The lever is supported rotatably on the housing by causing the arms to face the outer side surfaces of the housing and engaging the bearing holes with the supporting shafts on the outer side surfaces of the housing.

The operable portion of the lever faces an outer side surface of the housing when the lever is at an initial position. However, the operable portion is displaced toward the back surface of the connector housing as the lever is rotated from the initial position toward a connection position.

This lever-type connector is connected with a mating connector by holding the lever at the initial position so that entrances of cam grooves open toward the mating connector. Cam pins of the mating connector are inserted into the cam grooves and then the lever is rotated toward the connection position. Thus, the mating connector is pulled into and connected with the lever-type connector by a cam action between the cam grooves and pins.

Forces generated between the cam pins and the cam grooves during connection tend to move the arms wider apart and away from the outer side surfaces of the housing. As the arms are displaced wider apart, the bearing holes are displaced from the base ends of the supporting shafts toward the projecting ends thereof and in a direction to be disengaged from the supporting shafts. Therefore, there is a possibility of reducing the reliability of a bearing hole supporting function by the supporting shafts.

Displacement of the operable portion toward the back surface of the connector housing can create a problem. In particular, wires are drawn out through the back surface of the housing and could interfere with the lever. Thus, the connector must have a wire cover that covers the back surface of the housing and the wires. As a result, the wires extend laterally substantially parallel with the back surface of the housing in the wire cover to avoid the interference with the operable portion. The wire cover increases the number of parts and complicates assembly. A lever-type connector with a wire cover is disclosed, for example, in Japanese Unexamined Utility Model Publication No. 5-8882.

The present invention was developed in view of the above problem and an object thereof is to improve the operability of a lever-type connector.

SUMMARY OF THE INVENTION

The invention relates to a lever-type connector that has a housing with opposite outer side surfaces. The connector also has a lever with an operable portion and arms that project from opposite ends of the operable portion. The lever is supported rotatably on the housing by causing the arms to face the outer side surfaces of the housing. Bearing holes formed in the arms or the housing then are engaged with supporting shafts in the other of the arms and the housing. A mating connector can be pulled into the housing and connected therewith by a cam action of a cam mechanism when the lever is rotated. The supporting shafts project in from the inner side surfaces of supporting walls on the housing to at least partly face the outer side surfaces of the arms. Accordingly, the reliability of a lever supporting function is secured even if the arms try to move apart due to the engagement of cam pins and cam grooves.

Cam pins may project from outer side surfaces of the mating connector and may engage with cam grooves in the inner side surfaces of the arms. Thus, the mating connector is pulled into the housing and connected therewith by the cam action of the cam grooves and the cam pins as the lever is rotated.

The bearing holes preferably are formed in the arms of the lever and the supporting shafts preferably project in from the inner side surfaces of the supporting walls on the housing to face the outer side surfaces of the arms. The arms may try to move wider apart when the cam pins engage the cam grooves, and the bearing holes may displace from the projecting ends of the supporting shafts toward the base ends thereof. However, such displacements do not reduce engaging areas of the bearing holes with the supporting shafts, and the supporting function of the bearing holes by the supporting shafts is not reduced.

The outer side surfaces of the arms preferably are substantially in contact with the inner side surfaces of the supporting walls. Thus, forces that would move the arms wider apart when the cam pins engage the cam grooves cause no significant widening displacement of the arms.

A slanted guide surface is formed in the outer side surface of each arm and is inclined to thin the arm gradually from the edge of the bearing hole toward the outer periphery of the arm. The supporting shafts face the slanted guide surfaces when the bearing holes engage the supporting shafts. Thus, interference of the outer peripheries of the arms with the supporting shafts can be avoided. As a result, an assembling operability becomes better.

The slanted guide portion preferably has a trapezoidal shape by gradually widening a width thereof from the bearing holes toward the outer peripheries of the arms.

The housing may have one or more wires drawn out through a back surface thereof. The lever may be mounted on the housing for rotation about the free ends of the arms between an initial position and a connection position. The lever may be at or near the initial position when the lever-type connector is to be connected with a mating connector, and is rotated toward the connection position to pull the mating connector toward the lever-type connector by the cam mechanism. The operable portion of the lever is at a position corresponding to a peripheral edge of the back surface of the housing and inside an outer side surface of the housing when the lever is at the initial position. The lever then is rotated from the initial position to the connection position so that the operable portion is displaced toward a front surface along the outer side surface of the housing. Thus, interference between the operable portion and the wires drawn out through the back surface of the housing can be avoided. Accordingly, a wire cover is not needed for bending the wires drawn out through the back surface of the housing in lateral direction, and the number of parts can be reduced.

The operable portion is inside the outer side surface of the housing and at a position along the wires without projecting above the outer side surface of the housing when the lever is at the initial position. Thus, the lever-type connectors can be transported in a bag with the levers at the initial position, and there is no danger that another connector could catch the operable portion and rotate the lever toward the connection position.

The housing and/or the lever may comprise engageable locking means for holding the lever at the connection position. Accordingly, the lever can be held at the connection position even when the lever-type connector is not connected with the mating connector.

The operable portion preferably is behind the front surface of the housing and corresponding to the outer side surface of the housing with the lever at the connection position. Thus, an angle of rotation between the initial position and the connection position of the lever is small as compared to a case where the operable portion is before the front surface of the housing.

The operable portion preferably is along the outer side surface of the housing with the lever at the connection position. Accordingly, the operable portion is near the outer side surface of the housing, and the connector is small as compared to a case where the operable portion is spaced far from the outer side surface of the housing with the lever at the connection position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
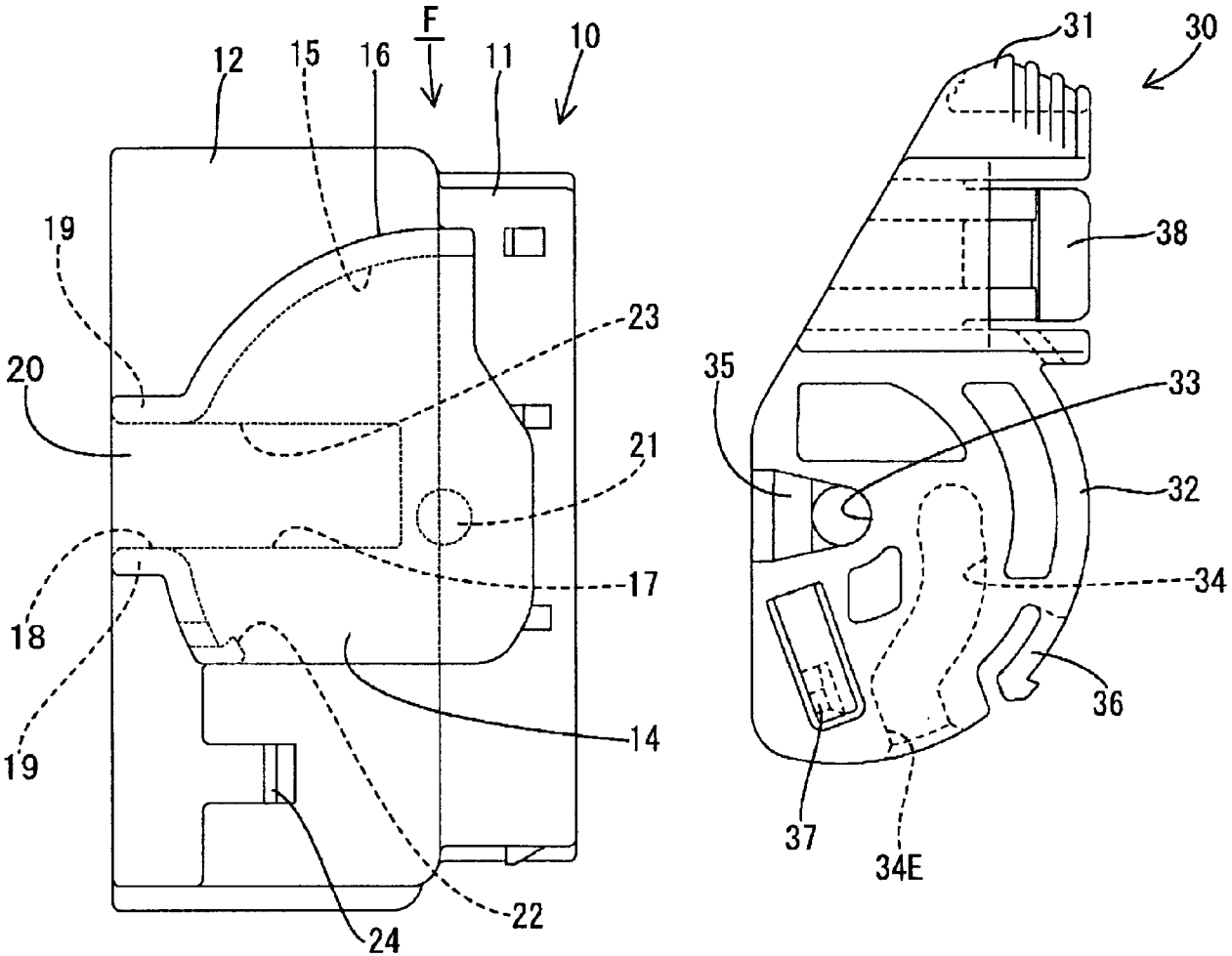
FIG. 1 is a side view showing a state where a lever is detached from a connector housing in an embodiment of the invention.

A lever-type connector F according to the invention is illustrated in FIGS. 1 to 12. The connector F is comprised of a housing 10 and a lever 30 each of which preferably is made of a synthetic resin. Female terminal fittings (not shown) are accommodated in the housing 10. The lever-type connector F can connect with a mating connector M that accommodates male terminal fittings (not shown). The mating connector M has a substantially rectangular receptacle Mf that projects forward toward a mating side, and a cam pin Mp projects from each of the left and right side surfaces of the receptacle Mf. In the following description, a mating side of the lever-type connector F (left side in FIGS. 1 to 3, 5 to 7) is referred to as the front side and reference is made to FIGS. 1 to 4 concerning the vertical direction thereof.

The housing 10 has a substantially block-shaped main body 11 with cavities 13 for accommodating the female terminal fittings (not shown). A rectangular tubular fitting 12 has a rear end coupled to the outer surface of the main body 11 over substantially the entire periphery and a front end that opens forwardly. Portions of the tubular fitting 12 between the front and rear ends are in spaced surrounding relationship to the main body 11. The rectangular receptacle Mf of the mating connector M can be fit into the space between the tubular fitting 12 and the main body 11.

Figure 2:
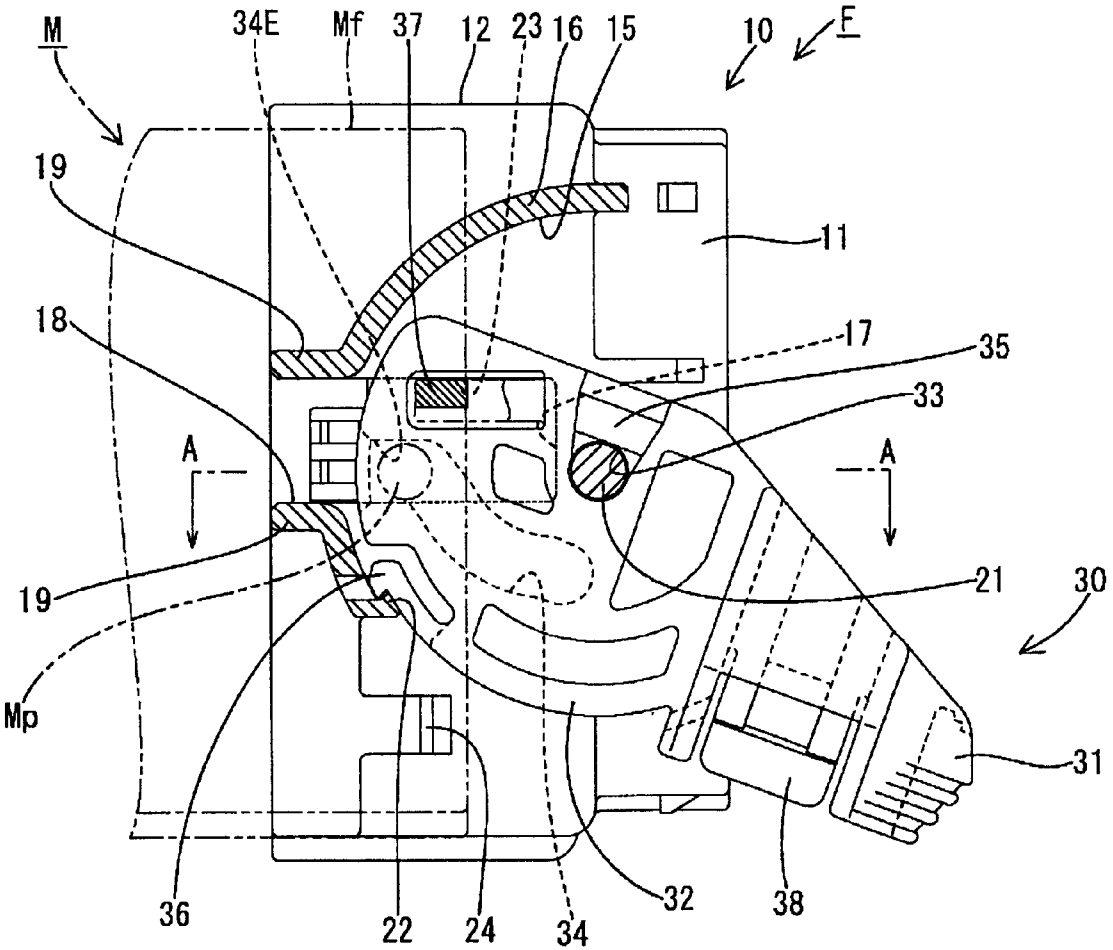
FIG. 2 is a side view partly in section showing a state where the lever is mounted on the connector housing.
Figure 3:
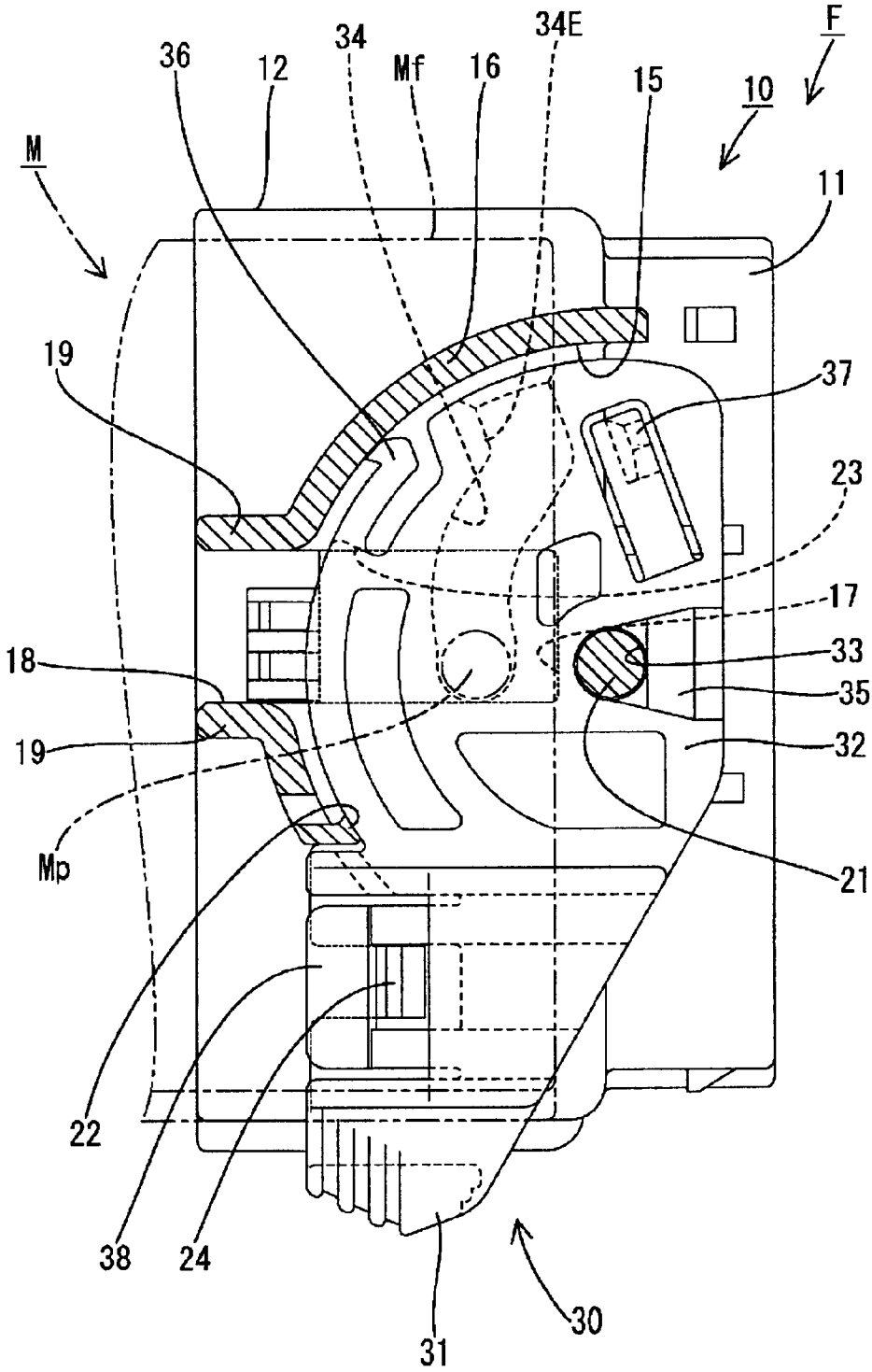
FIG. 3 is a side view partly in section showing a state where the lever is rotated from an initial position to a connection position.
Figure 4:
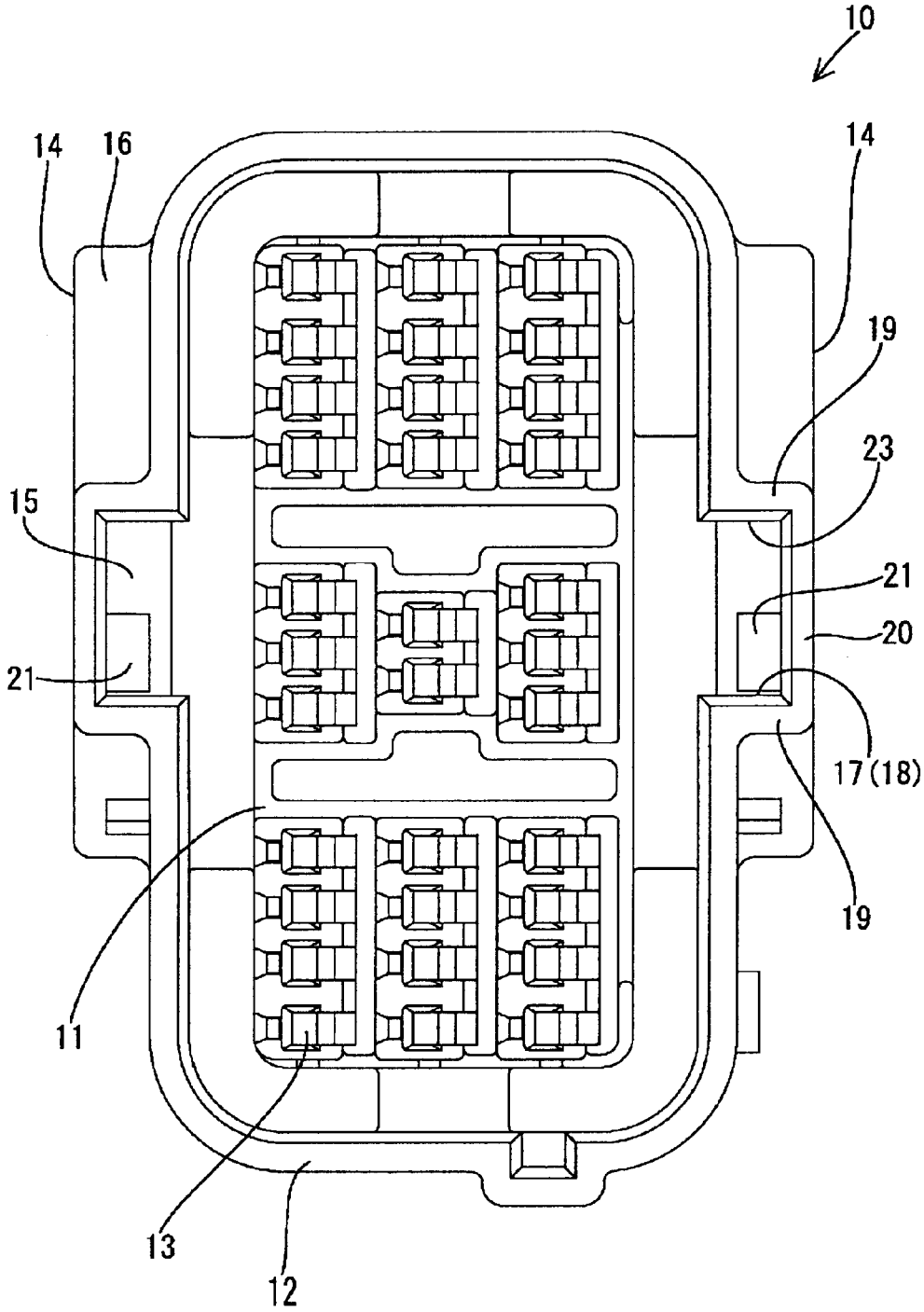
FIG. 4 is a front view of the connector housing.
Figure 5:
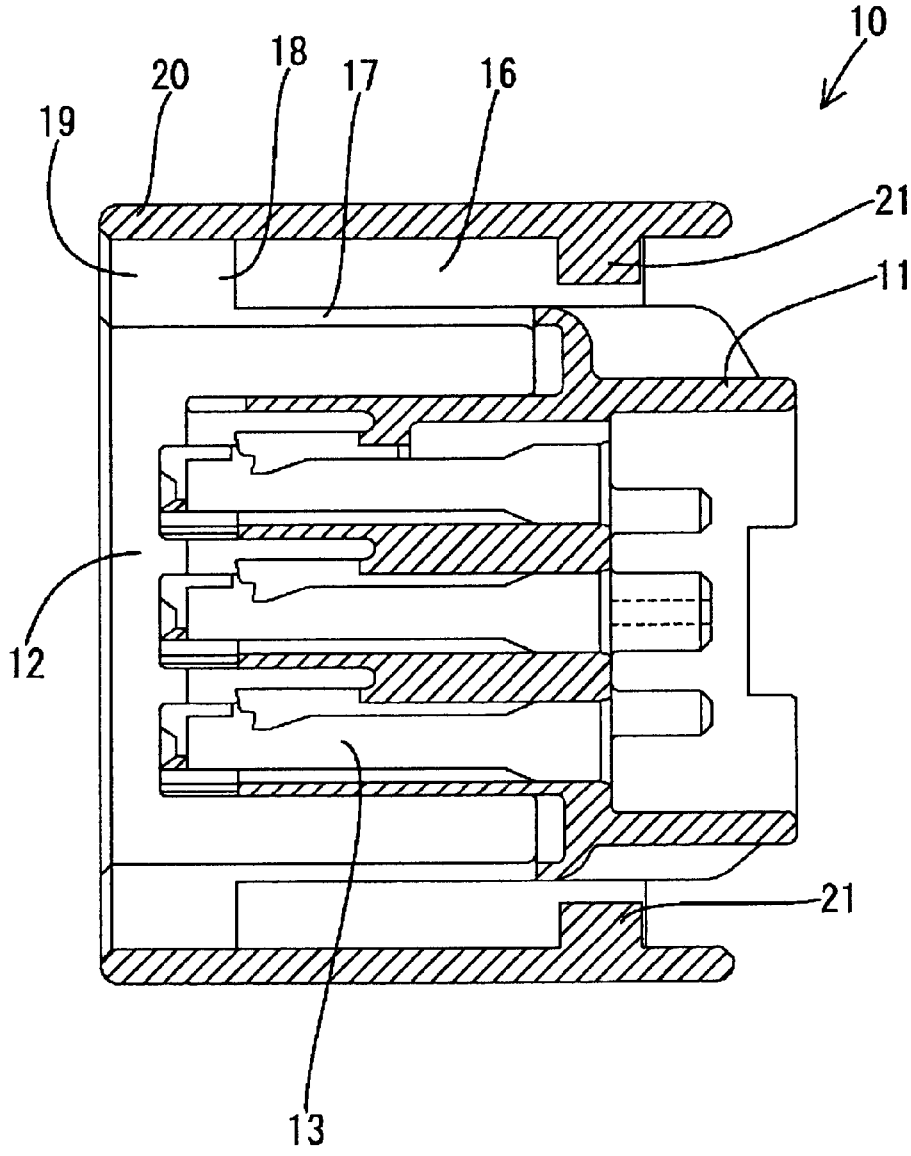
FIG. 5 is a section along 5—5 of FIG. 2.
Figure 6:
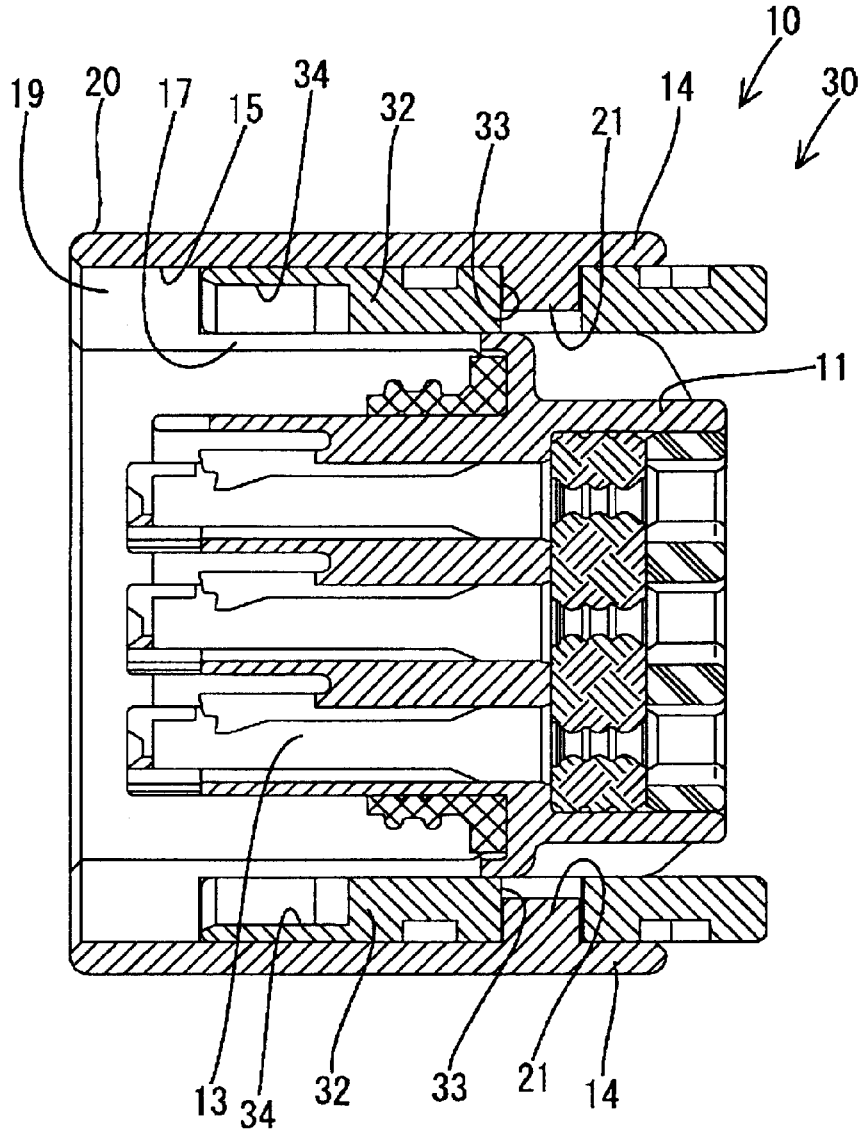
FIG. 6 is a section along 5—5 of FIG. 2 showing a state where the lever is at the initial position.
Figure 7:
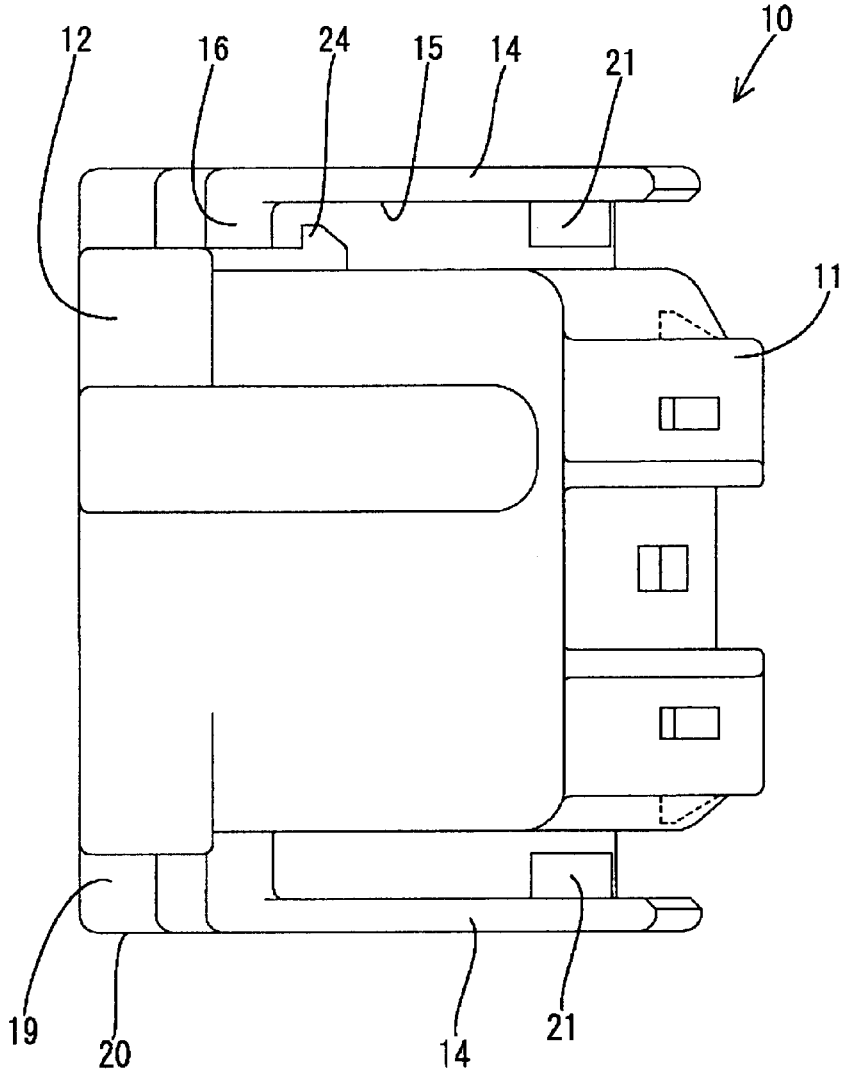
FIG. 7 is a bottom view of the connector housing.
Figure 8:
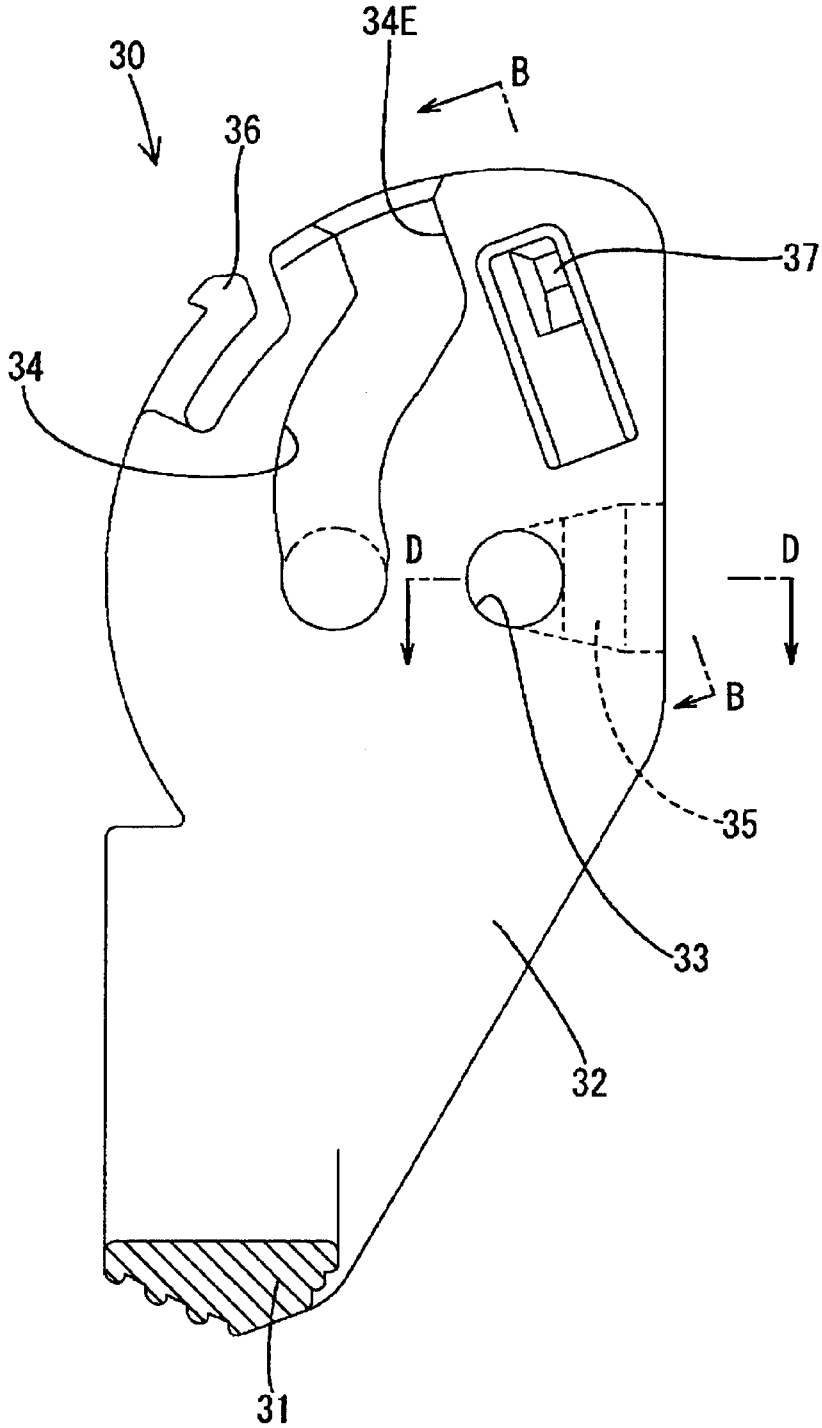
FIG. 8 is a side view in section of the lever.
Figure 9:
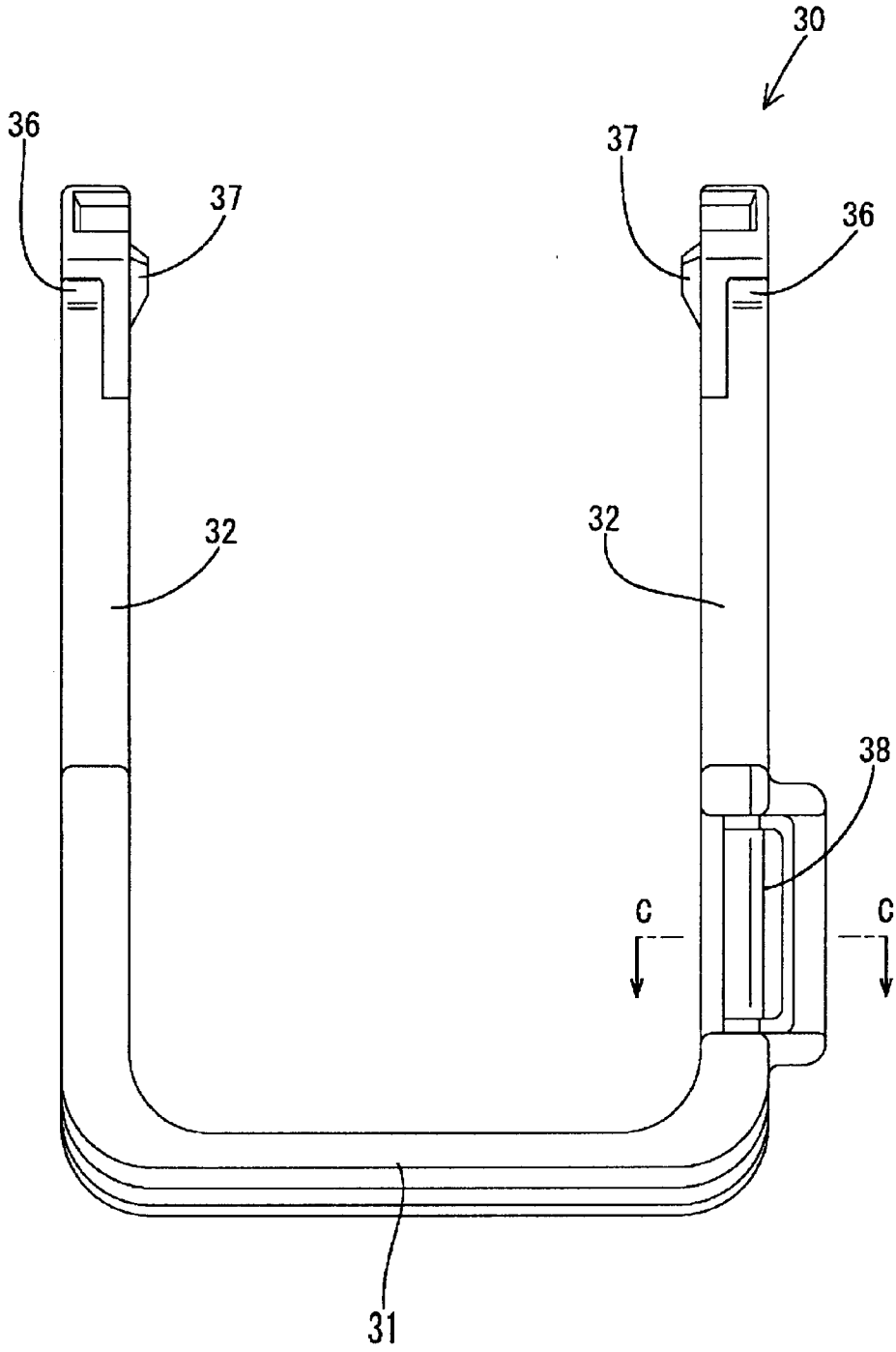
FIG. 9 is a front view of the lever.
Figure 10:
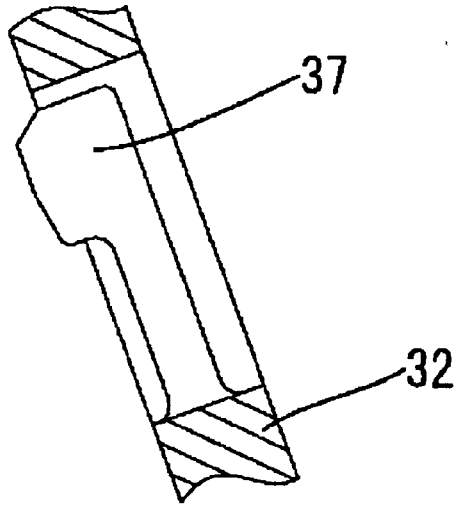
FIG. 10 is a section along 10—10 of FIG. 8.
Figure 11:
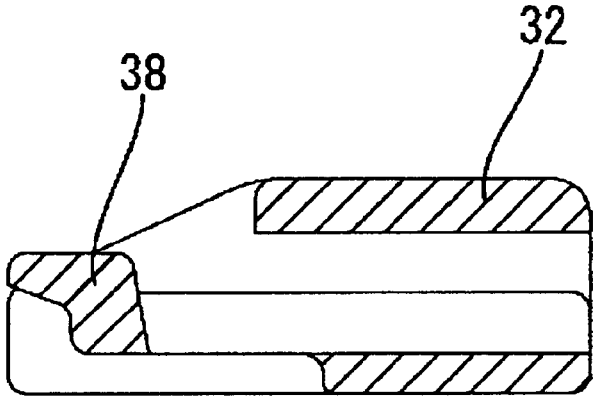
FIG. 11 is a section along 11—11 of FIG. 9.
Figure 12:
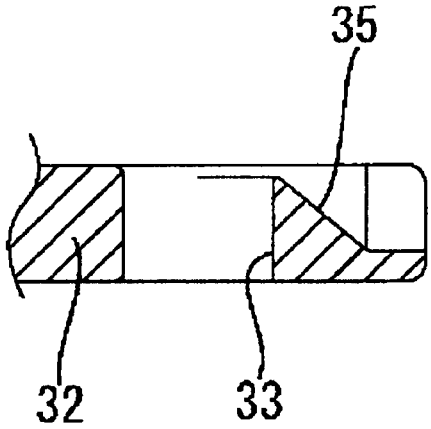
FIG. 12 is a section along 12—12 of FIG. 8.

Two supporting walls 14 face the left and right outer surfaces of the tubular fitting 12 and are spaced apart by a specified distance to define accommodation spaces 15 for the lever 30. Each supporting wall 14 is arcuate from its front end to its upper end. However, the bottom of each supporting wall 14 is straight along forward and backward directions, and the rear end extends substantially vertically. The arcuate edge of each supporting wall 14 is coupled to the outer surface of the tubular fitting 12 by an arcuate coupling walls 16 (FIGS. 2, 3). Thus, the accommodation space 15 between the tubular fitting 12 and the supporting wall 14 opens down and back from the mating side.

Escape grooves 17 extend back from a middle position of the tubular fitting 12 with respect to height direction and escape openings 18 are formed in the arcuate coupling walls 16 at locations aligned with the escape grooves 17. The cam pins Mp of the mating connector M can pass through the escape grooves 17 and the escape openings 18 to enter the accommodation spaces 15 between the tubular fitting 12 and the supporting walls 14. Upper and lower reinforcing ribs 19 extend forward from coupling walls 16 at the upper and bottom edges of the escape opening 18 and along the upper and bottom edges of the escape groove 17. A reinforcing wall 20 extends continuously between the reinforcing ribs 19 substantially flush with the supporting wall 14.

A substantially round support shaft 21 projects in toward the outer side surface of the tubular fitting 12 from the inner side surface of each supporting wall 14. The support shafts 21 are adapted to rotatably support the lever 30 on the connector housing 10. A small transverse spacing exists between the projecting end of the support shaft 21 and the outer side surface of the tubular fitting 12.

The housing 10 preferably is molded by a die that opens in forward and backward directions. The support shaft 21 aligns vertically with the escape opening 18 and the escape groove 17 (see FIG. 4). Accordingly, a sliding die that opens vertically (right/left direction in FIG. 4) is not necessary to mold the support shafts 21.

A claw 22 projects back from the bottom end of each coupling wall 16, and a lock 23 is defined on part of the upper edge of each escaping groove 17 of the tubular fitting 12. The claws 22 and locks 23 cooperate to hold the lever 30 at an initial position. A lock projection 24 projects out from one of the outer side surfaces of the tubular fitting 12 at a position below the supporting wall 14 and functions to lock the lever 30 at a connection position.

The lever 30 has a long and narrow transversely extending operable portion 31 and left and right substantially parallel plate-shaped arms 32 that extend from the opposite ends of the operable portion 31. Concentric round bearing holes 33 penetrate both arms 32 and support the lever 30 rotatably on the support shafts 21 of the housing 10. Thus, the arms 32 are accommodated in the accommodation spaces 15 between the tubular fitting 12 and the supporting walls 14. The inner side surfaces of the arms 32 substantially contact and slide on the outer side surfaces of the tubular fitting 12 (i.e. face them while being hardly spaced apart), and the outer side surfaces of the arms 32 substantially contact and slide on the inner side surfaces of the supporting walls 14 (i.e. face them while being hardly spaced apart). In other words, each arms 32 is slightly thinner than the spacing between the tubular fitting 12 and the supporting walls 14, and the arms 32 neither move loosely nor shake in the transverse direction with respect to the housing 10.

A substantially arcuate or spiral-shaped cam groove 34 having the bearing hole 33 as a center is formed in the inner side surface of each arm 32 and has an entrance 34E that opens at the outer periphery of the arm 32. The mating connector M is connected with or separated from the housing 10 by rotating the lever 30 with the cam pins Mp engaged in the cam grooves 34.

A slanted guide surface 35 is formed in the outer side surface of each arm 32 (FIGS. 1, 8, 12) such that the arm 32 is gradually thinned from the edge of the bearing hole 33 toward the outer periphery of the arm 32. The slanted guide surface 35 has a trapezoidal shape that gradually widens from the bearing hole 33 toward the outer periphery of the arm 32.

Each arm 32 has an arcuate first resilient locking piece 36 cantilevered along the outer periphery of the arm 32 for resilient deformation in a radial direction toward and away from the bearing hole 33. Each arm 32 also has a second resilient locking piece 37 surrounded by a substantially U-shaped slit and resiliently deformable in an axial direction. The first and second resilient locking pieces 36, 37 engage the claws 22 and the locks 23 of the housing 10, respectively, to lock the lever 30 at the initial position. The first and second resilient locking pieces 36, 37 deform and disengage from the claws 22 and the locks 23 if a torque of at least a specified magnitude is given to the lever 30 at the initial position, thereby permitting the lever 30 to rotate toward the connection position.

One arm 32 is formed with a resilient lock piece 38 at a position relatively close to the operable portion 31. The resilient lock piece 38 engages the lock projection 24 of the housing 10 when the lever 30 is rotated to the connection position. As a result the lever 30 is locked at the connection position and will not move loosely. The lever 30 is permitting to rotate toward the initial position when the resilient lock piece 38 is deformed and disengaged from the lock 24.

The lever 30 is mounted by first orienting the housing 10 and the lever 30, as shown in FIG. 1, with the support shafts 21 of the housing 10 facing the slanted guide surfaces 35 of the arms 32. The lever 30 then is brought closer to insert the arms 32 into the accommodation spaces 15 so that the slanted guide surfaces 35 contact the projecting ends of the support shafts 21. The slanted guide surfaces 35 are held substantially in sliding contact with the support shafts 21 as the arms 32 are inserted further, and the supporting walls 14 are pushed wider apart by the inclination of the slanted guide surfaces 35. The supporting walls 14 are restored resiliently inwardly when the bearing holes 33 reach the support shafts 21. Thus, the bearing holes 33 engage the support shafts 21 to support the lever 30 rotatably on the housing 10.

The lever 30 can be rotated down or clockwise in FIGS. 1 to 3 by exerting forces on the operable portion 31. Thus, the lever 30 reaches the initial position, shown in FIG. 2, and is locked so as not to move loosely. In this state, the entrances 34E of the cam grooves 34 face forward and align with the escape openings 18 of the supporting walls 14.

The housing 10 and the mating connector M are connected by initially fitting the receptacle Mf of the mating connector M at least partly into the tubular fitting 12 with the lever 30 held at the initial position (see FIG. 2). Thus, the cam pins Mp slide through the escape grooves 17 and the escape openings 18 into the entrances 34E of the cam grooves 34. Forces then are exerted on the operable portion 31 to rotate the lever 30 counter-clockwise in FIGS. 1 to 3. The cam pins Mp and the cam grooves 34 develop a cam action that pulls the mating connector M into the housing 10 as the lever 30 is rotated. The lever 30 becomes locked at the connection position (see FIG. 3) as the mating connector M becomes fitted properly.

The mating connector M can be detached by canceling the locking by the resilient lock piece 38 and rotating the lever 30 toward the initial position. Thus, the cam action returns the mating connector M forward from the connector housing 10. The mating connector M is pulled when the lever 30 reaches the initial position, and the cam pins Mp leave the cam grooves 34.

As described above, the supporting walls 14 are formed on the tubular fitting 12 of the housing 10 to face the outer side surfaces of the arms 32. The support shafts 21 project in from the inner side surfaces of the supporting walls 14 to engage the bearing holes 33 of the arms 32 and support the lever 30 rotatably. Thus, the support shafts 21 engage the bearing holes 33 of the arms 32 from outer sides. The arms 32 may be urged wider apart upon the engagement of the cam pins Mp and the cam grooves 34. However, the arms 32 are displaced to move the bearing holes 33 from the projecting ends of the support shafts 21 toward the base ends thereof. Therefore, such displacements do not reduce engaging areas of the bearing holes 33 with the support shafts 21. Hence, the outward movement of the arms 32 does not reduce reliability of the lever-type connector F.

The arms 32 can contact the inner side surfaces of the supporting walls 14. Accordingly, the inner side surfaces of the supporting walls 14 prevent the arms 32 from moving wider apart even though forces may urge the arms 32 wider apart when the cam pins Mp engage the cam grooves 34.

The slanted guide surfaces 35 of the arms 32 are inclined to thin the arms 32 gradually from the edges of the bearing holes 33 to the outer peripheries of the arms 32. The support shafts 21 face the slanted guide surfaces 35 when the bearing holes 33 engage the supporting shafts 21. Thus, the outer peripheries of the arms 32 will not interfere with the support shafts 21, and assembling operability is enhanced. Further, the slanted guide surfaces 35 preferably have a trapezoidal shape that gradually widens from the bearing holes 33 toward the outer peripheries of the arms 32. Thus, the support shafts 21 are guided to the bearing holes 33 even if the lever 30 is displaced vertically from the support shafts 21.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The invention is applied to a female connector with the female terminal fittings in the foregoing embodiment. However, it may be applied to a male connector with male terminal fittings.

Both arms are held substantially in contact with the inner side surfaces of the supporting walls in the foregoing embodiment. However, clearances may be defined between the outer side surfaces of the arms and the inner side surfaces of the supporting walls. In such a case, the supporting shafts may have a stepped shape such that the base end thereof has a larger diameter. The edges of the bearing holes in the outer side surfaces of the arms engage the stepped portions to prevent loose axial movements of the lever.

The arms are held substantially in contact with the outer side surfaces of the housing in the foregoing embodiment. However, clearances may be defined between the inner side surfaces of the arms and the outer side surfaces of the housing according to the present invention.

The bearing holes penetrate the arms from their outer side surfaces to their inner side surfaces in the foregoing embodiment. However, they may be formed by recessing the outer side surfaces of the arms without penetrating to the inner side surfaces of the arms.

A second embodiment of the invention is described with reference to FIGS. 13 to 15. A lever-type connector A of this embodiment is a female connector that accommodates female terminal fittings (not shown). The connector A has a housing 10 and a lever 30, both of which may be made of a synthetic resin. A mating connector B is connectable with the lever-type connector A from a front surface 10F, and accommodates male terminal fittings (not shown). The mating connector B includes a forwardly projecting substantially rectangular receptacle Bh and cam pins Bp that project from the left and right side surfaces of the receptacle Bf.

Figure 13:
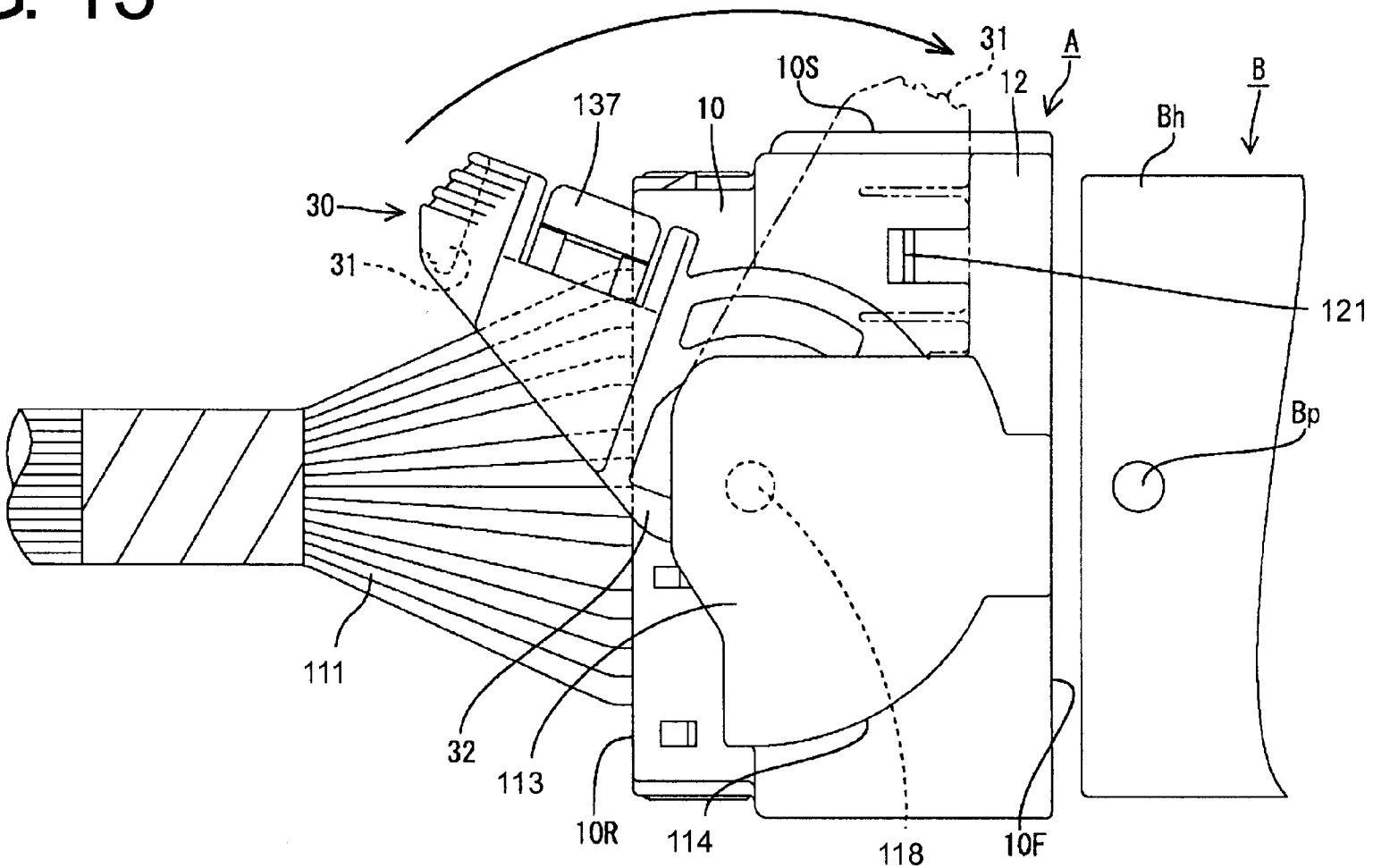
FIG. 13 is a side view showing a state where a lever is located at an initial position in a further preferred embodiment of the invention.
Figure 14:
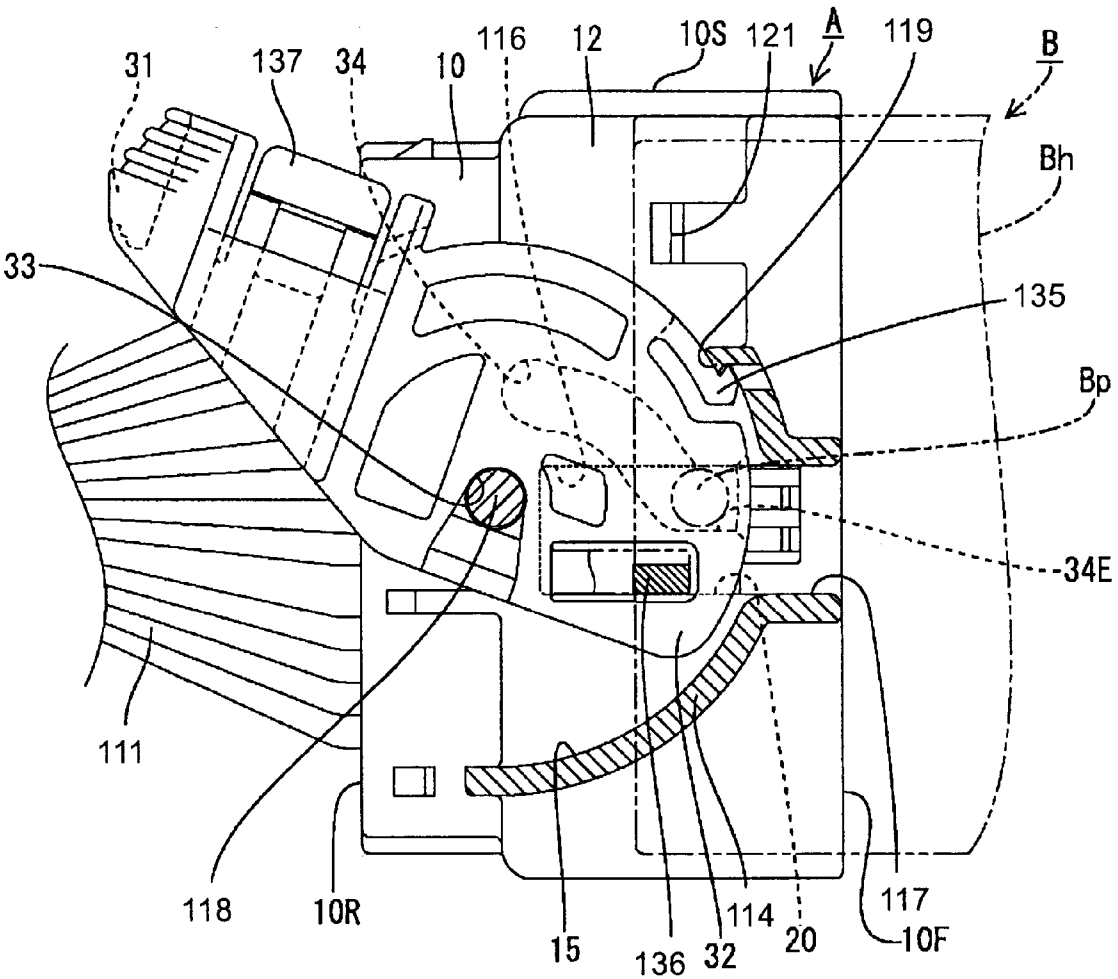
FIG. 14 is a side view partly in section showing a state where the lever is located at the initial position and cam pins of a mating connector enter cam grooves.
Figure 15:
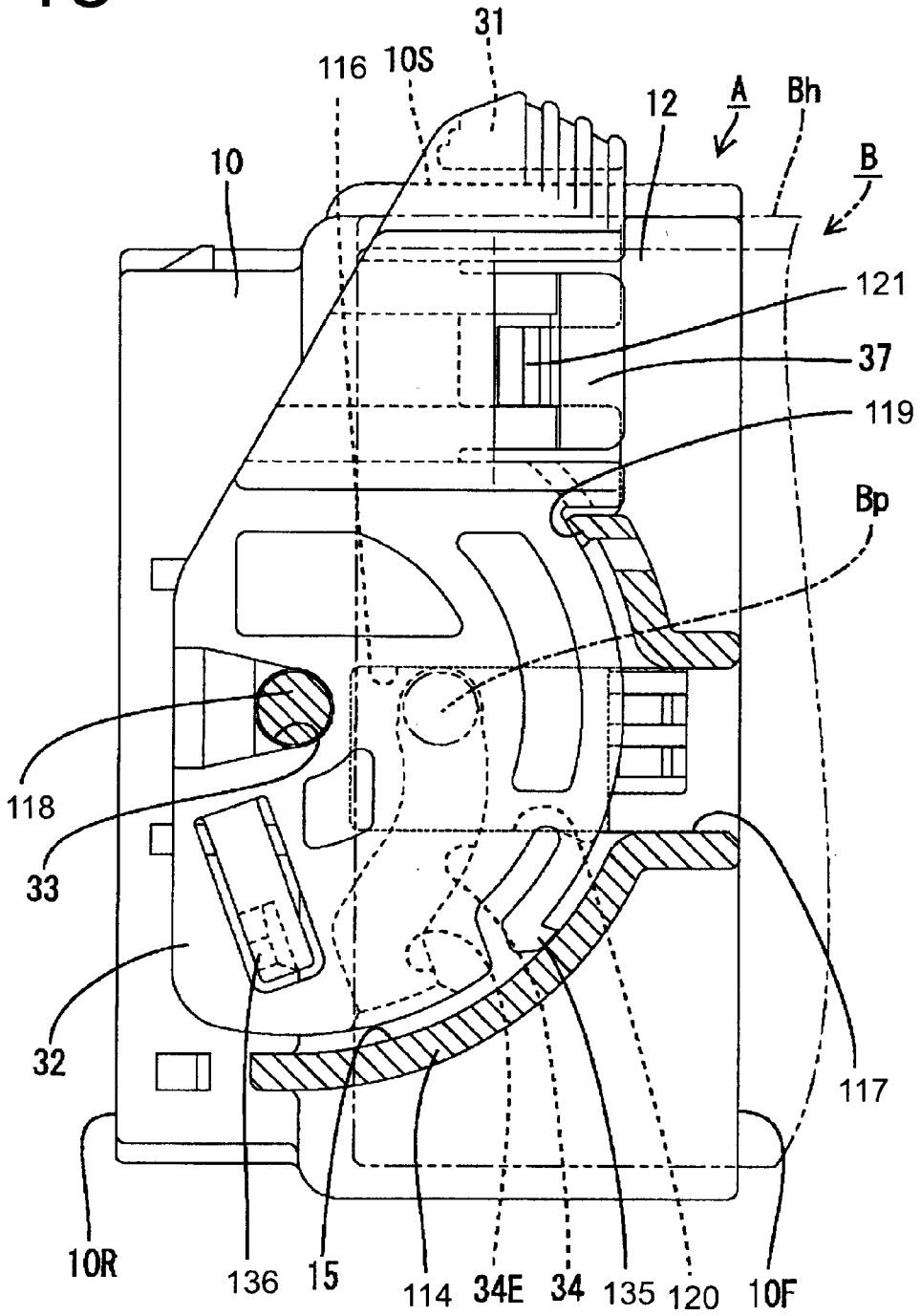
FIG. 15 is a side view partly in section showing a state where the lever is rotated to a connection position to be connected with the mating connector.

In the following description, the right side in FIGS. 13 to 15 is referred to as front side (toward the front surface 10F) and reference is made to FIGS. 13 to 15 concerning the vertical direction.

The housing 10 accommodates the female terminal fittings inside and wires 111 fastened to the female terminal fittings are drawn out through a rear surface 10R. The housing 10 has a forwardly projecting rectangular tubular fitting 12 and the receptacle Bh of the mating connector B can be fit into this tubular fitting 12. The tubular fitting 12 has supporting walls 113 that face the left and right outer surfaces of the tubular fitting 12 and that are spaced apart by a specified distance, as described with reference to the previous embodiment. Each supporting wall 113 is arcuate from its front end to its upper end. However, the bottom end of the supporting wall 113 is straight along forward and backward directions, and the rear end thereof is substantially vertical. The supporting wall 113 is coupled to the outer surface of the tubular fitting 12 by an arcuate coupling wall 114 in the arcuate area of the supporting wall 113 extending from the front end to the upper end. Thus, an accommodation space 15 between the tubular fitting 12 and the supporting wall 113 open down and toward the rear surface 10R.

The tubular fitting 12 is formed with escape grooves 116 that extend back from the front edge thereof, and the coupling walls 114 are formed with escape openings 117 substantially aligned with the escape grooves 116. The cam pins Bp of the mating connector B can pass through the escape grooves 116 and the escape openings 117 to enter the accommodation spaces 15 between the tubular fitting 12 and the supporting walls 113. A round support shaft 118 projects in toward the outer side surface of the tubular fitting 12 from the inner side surface of each supporting wall 113. The lever 30 can be supported rotatably on the housing 10 by the support shafts 118.

A claw 119 projects back from the upper end of each coupling wall 114, and part of the bottom edge of each escape groove 116 defines a lock 120. The claws 119 and locks 120 function to hold the lever 30 at an initial position. A lock projection 21 is formed on at least one of the outer side surfaces of the tubular fitting 12 and projects out from a position above the supporting wall 113.

The lever 30 has a long narrow operable portion 31 and left and right substantially parallel plate-shaped arms 32 that extend from the opposite ends of the operable portion 31. The lever 30 is supported rotatably on the housing 10 by accommodating the two arms 32 in the accommodation spaces 15 and engaging bearing holes 33 in the arms 32 with the supporting shafts 118.

Arcuate cam grooves 34 are formed in the inner surfaces of the arms 32 and around the bearing holes 33. An entrance 34E of each cam groove 34 opens at the outer periphery of the arm 32. Rotation of the lever 30 develops a cam action between the cam grooves 34 the cam pins Bp of the mating connector B and pulls the mating connector B toward the housing 10.

An arcuate first resilient locking piece 135 is cantilevered along the outer periphery of each arm 32 and is resiliently deformable in a radial direction. Each arm 32 also has a second resilient locking piece 136 at least partly surrounded by a substantially U-shaped slit and resiliently deformable in axial direction. The first and second resilient locking pieces 135, 136 engage the claws 119 and the locks 120 of the housing 10 to lock the lever 30 at the initial position (see FIG. 14). The first and second resilient locking pieces 135, 136 deform and disengage from the claws 119 and the locks 120 in response to a torque on the lever 30 of at least a specified magnitude so that the lever 30 can rotate toward the connection position.

One arm 32 is formed with a resilient lock piece 137 that engages the lock projection 21 of the housing 10 when the lever 30 is rotated to the connection position (see FIG. 15). Thus, the lever 30 is locked at the connection position and will not move loosely. The resilient lock piece 137 can be deformed resiliently to disengage from the lock projection 21 so that the lever 30 can rotate toward the initial position.

The entrances 34E of the cam grooves 34 face forward toward the front surface 10F and align with the escape openings 117 of the supporting walls 113, as shown in FIG. 13, when the lever 30 is at the initial position. Additionally, the operable portion 31 is behind or near the back surface 10R of the housing 10 with respect to forward and backward directions and is at a position corresponding to the upper edge of the back surface 10R of the housing 10. Thus, the operable portion 31 is above an area of the back surface 10R of the connector housing 10 where the wires 111 are drawn out so as to avoid interference with the drawn wires 111. The operable portion 31 also is below the upper surface 10S of the housing 10 (projects less from the longitudinal axis than the upper surface).

The operable portion 31 traces an arc toward the front surface 10F and substantially along the upper surface 10S of the housing 10 as the lever 30 is rotated from the initial position to the connection position. The operable portion 31 is behind the front surface 10F of the housing 10 and near the upper surface 10S of the housing 10 when the lever 30 is at the connection position.

The housing 10 and the mating connector B are connected by initially fitting the receptacle Bh of the mating connector B partly into the tubular fitting 12 with the lever 30 held at the initial position (see FIG. 14). Thus, the cam pins Bp pass through the escape grooves 116 and the escaping openings 117 and enter the entrances 34E of the cam grooves 34. The lever 30 then is rotated clockwise in FIG. 15 by holding the operable portion 31. The mating connector B is pulled into the housing 10 by the cam action developed between the cam pins Bp and the cam grooves 34 as the lever is rotated. The lever 30 is locked at the connection position when the mating connector B is fit properly (see FIG. 15).

The mating connector B is detached by canceling the locking of the resilient lock piece 137 and rotating the lever 30 toward the initial position. Thus, the mating connector B is returned forward from the housing 10 by the cam action, and can be pulled when the lever 30 reaches the initial position so that the cam pins Bp separate from the cam grooves 34.

As described above, the operable portion 31 is not at the center of the rear surface 10R of the housing 10 and adjacent the draw-out area of the wires 111 when the lever 30 is at the initial position. Rather, the operable portion 31 is at the upper edge of the rear surface 10R and above the draw-out area of the wires 111 when the lever 30 is at the initial position. As the lever 30 is rotated from the initial position to the connection position, the operable portion 31 is displaced toward the front surface 10F, away from the wires 111 and along the upper surface 10S of the housing 10. Thus, there is no interference between the operable portion 31 and the wires 111 drawn out through the back surface 10R of the housing 10. This obviates the need for a wire cover for bending the wires 111 drawn out through the back surface 10R of the housing 10 and the number of the parts can be reduced.

The operable portion 31 is below the upper surface 10S of the housing 10 with the lever 30 at the initial position. Thus, the lever-type connectors A can be transported in a bag with the levers 30 at the initial position and there is little danger that the operable portion 31 will get caught by another lever-type connector to rotate the lever 30 toward the connection position.

The resilient lock piece 137 and the lock projection 21 are provided at the lever 30 and the housing 10 for holding the lever at the connection position. Thus, the lever 30 can be held at the connection position even when the lever-type connector A is not connected with the mating connector B.

The operable portion 31 is behind the front surface 10F of the housing 10 and is substantially adjacent the upper surface 10S of the housing 10 when the lever 30 is at the connection position. Thus, an angle of rotation between the initial position and the connection position of the lever 30 is small as compared to a case where the operable portion is before the front surface of the housing 10.

The operable portion 31 is at the position and along or near the upper surface 10S of the housing 10 with the lever 30 at the connection position. Thus, the lever-type connector A is smaller as compared to a case where the operable portion is spaced far from the upper surface of the housing with the lever at the connection position.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The lever is engaged with the housing at the connection position in the foregoing embodiment. However, it may be held at the connection position by being engaged with the mating connector according to the present invention.

Although the operable portion is behind the front surface of the housing with the lever at the connection position in the foregoing embodiment, it may be before the front surface of the housing with the lever at the connection position.

Although the operable portion is along and near the outer surface of the housing with the lever at the connection position in the foregoing embodiment, it may be spaced further from the outer side surface of the housing according to the present invention.

What is claimed is:

1. A lever-type connector, comprising:

a housing having opposite first and second sides, first and second supporting walls supported in spaced relationship outwardly from the opposite respective first and second sides of the housing, rotation, first and second supports shafts projecting inwardly from the respective first and second supporting walls, such that each of said support shafts has a base end integral with the respective supporting wall and a projecting end spaced from the housing;

a lever having an operable portion, first and second arms projecting from opposite ends of the operable portion, the arms having bearing holes rotatably engaging the supports shafts of the housing for rotation about the support shafts without translation relative to the support shafts, the arms of the lever having cam means for engaging corresponding cam structures on a mating connector for moving the mating connector relative to the housing in response to rotation of the lever; and wherein the supports of the housing and the bearing holes of the arms are inwardly of the supporting walls on the housing for limiting outward deformation of the arms away from one another.

2. The lever-type connector of claim 1, wherein the cam means of the arms comprise cam grooves formed on inwardly facing surfaces of the arms, the cam structures on the mating connector comprising cam pins engageable with cam grooves.

3. The lever-type connector of claim 1, wherein outer side surfaces of the arms are substantially in contact with inner side surfaces of the supporting walls.

4. A lever-type connector comprising:

a housing having opposite sides, supporting walls supported in spaced relationship outwardly from the opposite sides of the housing, rotation supports being formed on the supporting walls;

a lever having an operable portion, bearing holes in each said arm, each said arm having a slanted guide surface for gradually thinning the arm from an edge of the bearing hole toward an outer periphery of the arm, the arms of the lever having cam means for engaging corresponding cam structures on a mating connector for moving the mating connector relative to the housing in response to rotation of the lever; and wherein the rotation supports of the housing and the bearing holes of the arms are inwardly of the supporting walls on the housing for limiting outward deformation of the arms away from one another.

5. The lever-type connector of claim 4, wherein the slanted guide portions have a trapezoidal shape that gradually widens from the bearing holes toward the outer peripheries of the arms.

6. A lever-type connector for connection with a mating connector that has cam structures formed thereon, comprising:

a housing with a front surface for connection with the mating connector and a rear surface for accommodating wires; and a lever having an operable portion, arms extending from opposite ends of the operable portion and having free ends supported on the housing for rotation of the lever between an initial position and a connection position, cam means formed on the arms for engaging the cam structures on the mating connector when the lever-type connector is at the initial position and for pulling the mating connector toward the housing when the lever is rotated toward the connection position, wherein the operable portion is at a peripheral edge of the rear surface of the housing and inside an outer side surface of the housing when the lever is at the initial position, and the operable portion is displaced toward a front surface along the outer side surface of the housing when the lever is rotated from the initial position toward the connection position, wherein the cam means are cam grooves formed on inwardly facing surfaces of the arms, the cam structures on the mating connector being cam pins, the cam grooves of the arms having entrances that open toward the front surface when the lever is at the initial position for receiving the cam pins.

7. The lever-type connector of claim 6, wherein the housing and the lever comprise locking means engageable with each other to hold the lever at the connection position.

8. The lever-type connector of claim 6, wherein the operable portion is behind the front surface of the housing and substantially adjacent the outer side surface of the housing when the lever is at the connection position.

9. The lever-type connector of claim 8, wherein the operable portion is substantially adjacent the outer side surface of the housing when the lever is at the connection position.

* * * * *